US007296983B2

(12) United States Patent
Okada et al.

(10) Patent No.: US 7,296,983 B2
(45) Date of Patent: Nov. 20, 2007

(54) GAS COMPRESSION APPARATUS CAPABLE OF PREVENTING LUBRICANT LEAKAGE

(75) Inventors: Hiroshi Okada, Anjo (JP); Eitaro Tanaka, Oobu (JP)

(73) Assignee: Denso Corporation, Kariya (JP)

( * ) Notice: Subject to any disclaimer, the term of this patent is extended or adjusted under 35 U.S.C. 154(b) by 284 days.

(21) Appl. No.: 10/961,098

(22) Filed: Oct. 12, 2004

(65) Prior Publication Data

US 2005/0084404 A1 Apr. 21, 2005

(30) Foreign Application Priority Data

Oct. 17, 2003 (JP) ..... 2003-357998

(51) Int. Cl.
*F03C 2/00* (2006.01)

(52) U.S. Cl. ..... 418/104; 418/201.1

(58) Field of Classification Search ..... 418/87, 418/97, 104, 270, 201.1, 201.2, 206.1, 206.6–206.8, 418/DIG. 1; 184/6.16
See application file for complete search history.

(56) References Cited

U.S. PATENT DOCUMENTS 4,153,395 A * 5/1979 O'Neill ..... 418/104
4,781,553 A * 11/1988 Nomura et al. ..... 418/104
5,836,753 A * 11/1998 Takei et al. ..... 418/104
6,612,820 B1 * 9/2003 Staat et al. ..... 418/201.1
6,663,366 B2 * 12/2003 Okada et al. ..... 418/201.1

FOREIGN PATENT DOCUMENTS

JP 62261689 A * 11/1987 ..... 418/201.1
JP A-5-312165 11/1993
JP A-2001-182680 7/2001
SU 1679059 A1 * 9/1991

* cited by examiner

*Primary Examiner*—Theresa Trieu
(74) *Attorney, Agent, or Firm*—Posz Law Group, PLC

(57) ABSTRACT

In a gas compression apparatus, a space (41*a*) between oil seals (18, 23) and bearings (15, 21) is adapted to communicate with a low pressure lead hole (42) open to the atmosphere through a blow-down lead hole (41). The low pressure lead hole is opened/closed by an on-off valve (43) arranged on the side of the blow-down lead hole nearer to the low pressure lead hole. As a result, when the gas compression apparatus stops operation, the internal pressures of the space (41*a*) and a lubricant space (9) drop while the internal pressure of a compression chamber (10*a*) drops. A valve body (44) thus moves down and opens the low pressure lead hole, so that the internal pressure of the lubricant space becomes substantially equal to the atmospheric pressure. Thus, the lubricant is prevented from leaking from the lubricant space into the compression chamber.

11 Claims, 6 Drawing Sheets

GAS COMPRESSION APPARATUS CAPABLE OF PREVENTING LUBRICANT LEAKAGE

BACKGROUND OF THE INVENTION

1. Field of the Invention

The present invention relates to a gas compression apparatus, applicable effectively to a screw pump, in which the lubricant oil cannot be mixed with the discharge gas.

2. Description of the Related Art

A gas compression apparatus comprising a fixed member and rotative members for compressing and discharging a gas includes bearings for supporting the rotative members rotatably, which bearings are normally supplied with a lubricant oil from a lubricant space containing the lubricant oil.

In a prior art, an intermediate pressure chamber communicating with a compression chamber in the compression process is formed in a seal section on a discharge side in order to suppress the reduction in volume efficiency due to the leakage of the lubricant oil from the compression chamber to the lubricant space, as disclosed in Japanese Unexamined Patent Publication No. 2001-182680.

In another prior art, as disclosed in Japanese Unexamined Patent Publication No. 5-312165, a gear chamber and a compression chamber communicate with each other through a pressure balance chamber. In the case where the internal pressure of the gear chamber increases beyond the internal pressure of the compression chamber, a check valve is opened to release the internal pressure of the gear chamber into the compression chamber. In this way, the pressure difference between the gear chamber and the compression chamber is reduced to thereby reduce the friction force generated by a seal member for a rotor shaft arranged through a partitioning wall between the gear chamber and the compression chamber.

A gap between the shaft, arranged through a partitioning wall between the lubricant space and the compression chamber, and the partitioning wall is hermetically sealed by the seal member, as described above. In view of the fact that the shaft rotates while in contact with the seal member, however, the lubricant space and the compression chamber undesirably communicate with each other through a minuscule gap generated at the contact surfaces of the shaft and the seal member. It is therefore difficult to completely shut off the lubricant space and the compression chamber from each other.

As long as the gas compression apparatus is in operation, however, the internal pressure of the compression chamber is higher than the internal pressure of the lubricant space. Therefore, the amount of the lubricant oil leaking into the compression chamber from the lubricant space through the minuscule gap generated at the contact surfaces of the shaft and the seal member is negligibly small. Thus, the possibility is very low that the lubricant oil mixes with the discharge air. As the internal pressure of the compression chamber is higher than the internal pressure of the lubricant space, however, the high-pressure gas in the compression chamber leaks into the lubricant space through the minuscule gap generated at the contact surfaces of the shaft and the seal member.

In the case where the operation of the gas compression apparatus is stopped with a high internal pressure of the lubricant space, the internal pressure of the lubricant space increases to beyond the internal pressure of the compression chamber unlike in the case where the gas compression apparatus is in operation. As a result, the lubricant oil in the lubricant space is liable to leak out into the compression chamber through the minuscule gap generated at the contact surfaces of the shaft and the seal member.

Once the lubricant oil comes to stay in the compression chamber while the gas compression apparatus is out of operation, therefore, the lubricant oil staying in the compression chamber is discharged out of the gas compression apparatus together with the discharge gas when the operation of the gas compression apparatus is restarted.

SUMMARY OF THE INVENTION

In view of the situation described above, the object of this invention is firstly to provide a novel gas compression apparatus different from the prior art and secondly to prevent lubricant oil from leaking out into a compression chamber while the gas compression chamber is out of operation.

In order to achieve the object described above, according to a first aspect of the invention, a gas compression apparatus comprises: rotative members (1, 2) rotated in a housing (7); bearings (15, 21) for rotatably supporting the rotative members (1, 2); a lubricant space (9) sealed with lubricant oil for lubricating the bearings (15, 21); seal members (18, 23) for preventing the lubricant oil from leaking into a compression chamber (10*a*) defined by the housing (7) and the rotative members (1, 2); and an on-off valve (43) for opening/closing a low pressure lead hole (42) for establishing communication between a space (41*a*) nearer to the bearings (15, 21) from the seal members (18, 23) and a low pressure side and when an internal pressure of the space (41*a*) drops to at least a predetermined level, opening the low pressure lead hole (42).

As a result, when the gas compression apparatus stops, the internal pressure of the space (41*a*) and the lubricant space (9) decreases at the same time when the internal pressure of the compression chamber (10*a*) decreases, and the low-pressure lead hole (42) opens. Therefore, the pressure of the lubricant space (9) decreases.

Thus, the internal pressure of the lubricant space (9) is prevented from increasing beyond the internal pressure of the compression chamber (10*a*) and, therefore, the lubricant oil is prevented from leaking into the compression chamber (10*a*) from the lubricant space (9).

According to a second aspect of the invention, there is provided a gas compression apparatus, wherein the on-off valve (43) has a maze structure of a path connecting the low pressure lead hole (42) and the space (41*a*) while the low pressure lead hole (42) is open.

As a result, gas, which is low in density and easily flows, is discharged from the low pressure lead hole (42) to the low pressure side, while lubricant oil higher in density and less liable to flow than the gas remains behind. Therefore, the lubricant oil is prevented from being wholly discharged to the low pressure side, while discharging only the gas quickly to the low pressure side to thereby reduce the internal pressure of the space (41*a*) and the lubricant space (9).

Further, while preventing the lubricant oil from being reduced in amount, the lubricant oil can be positively prevented from leaking from the lubricant space (9) into the compression chamber (10*a*).

According to a third aspect of the invention, there is provided a gas compression apparatus, wherein the valve body (44) of the on-off valve (43) includes a cylindrical portion (44*a*) having a cylindrical shape and a lid (44*b*) for closing an axial end of the cylindrical portion (44*a*). Further, a plurality of grooves (44*c*) are formed at an axial end of the cylindrical portion (44*a*) far from the lid (44*b*).

As a result, a path connecting the low pressure lead hole (42) and the space (41*a*) can be formed as a maze and, therefore, as in the second aspect described above, the lubricant oil is prevented from decreasing in amount, while at the same time positively preventing the lubricant oil from leaking from the lubricant space (9) into the compression chamber (10*a*).

According to a fourth aspect of the invention, there is provided a gas compression apparatus, wherein the valve body (44) is subjected to the force in such a direction as to open the low pressure lead hole (42) by the pressure of a low pressure side acting on the valve body (44) and the gravity on the valve body (44), while the valve body (44) is subjected to the force in such a direction as to close the low pressure lead hole (42) by the internal pressure of the space (41*a*).

According to a fifth aspect of the invention, there is provided a gas compression apparatus, wherein a direction in which the valve body (44) moves is not more than ±45 degrees from the normal.

According to a sixth aspect of the invention, a gas compression apparatus, further comprises a lubricant return path (46) for returning the lubricant oil staying in the on-off valve (43) side to the lubricant space (9).

As a result, the lubricant oil staying in the on-off valve (43) side can be returned to the lubricant space (9) and, therefore, the gas flow can be prevented from being blocked by the stagnant lubricant. Thus, as soon as the gas compression apparatus stops, the high-pressure gas in the space (41*a*) and the lubricant space (9) can be quickly discharged to the low pressure side.

According to a seventh aspect of the invention, there is provided a gas compression apparatus, wherein the low pressure lead hole (42) is open to the atmosphere.

The reference numerals in the parentheses attached to the names of the component parts described above indicate an example of correspondence with the specific means described in the embodiments below.

The present invention may be more fully understood from the description of the preferred embodiments of the invention set forth below, together with the accompanying drawings.

DESCRIPTION OF THE PREFERRED EMBODIMENTS

First Embodiment

This embodiment represents an application of a gas compression apparatus according to the present invention to a supercharger for pressuring combustion air supplied to an internal combustion engine.

Figure 1:
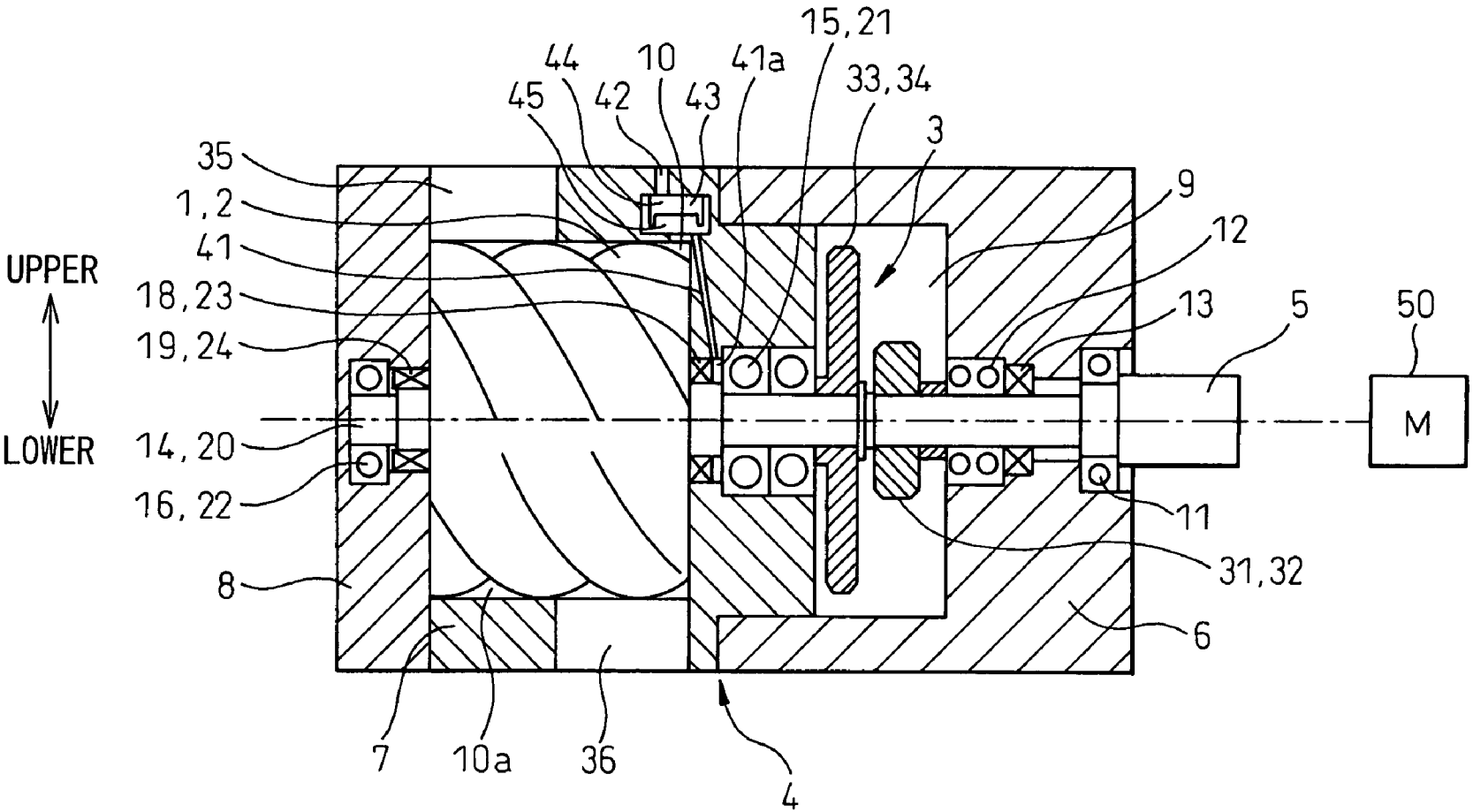
FIG. 1 is a sectional view taken along the axis of a gas compression apparatus according to a first embodiment of the present invention.
Figure 2:
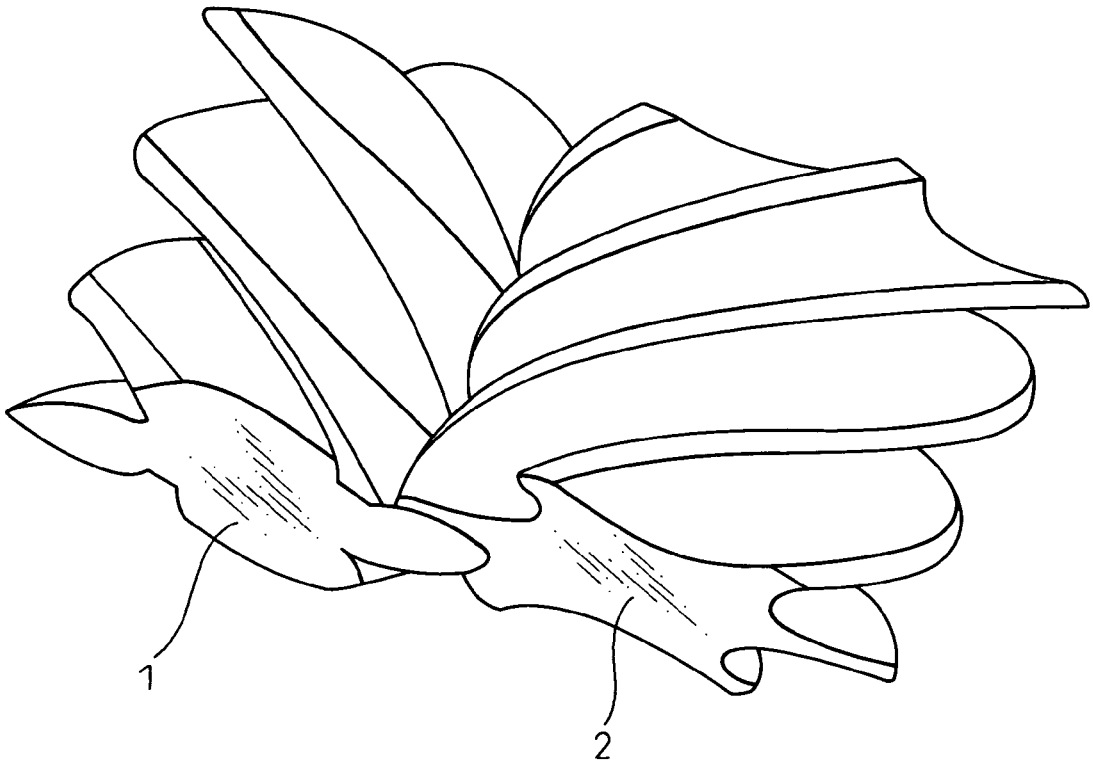
FIG. 2 is a perspective view of a pair of rotors of the gas compression apparatus according to the first embodiment of the invention.
Figure 3:
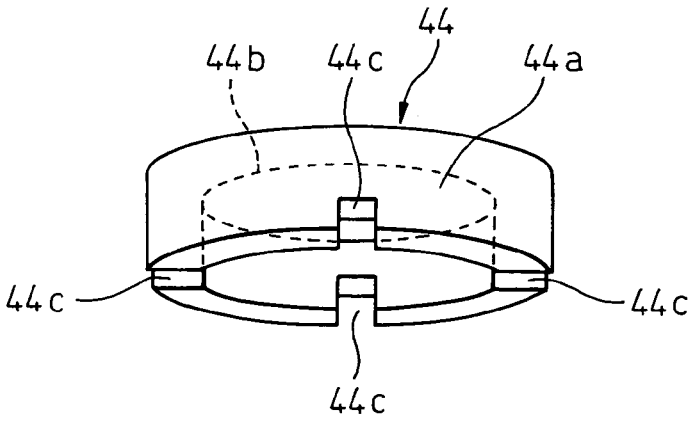
FIG. 3 is a perspective view of a valve body of the gas compression apparatus according to the first embodiment of the invention.

FIGS. 1, 2 and 3 are diagrams showing a gas compression apparatus according to this embodiment, in which FIG. 1 is a sectional view of the gas compression apparatus, FIG. 2 is a perspective view of a pair of rotors, and FIG. 3 is a perspective view of a valve body.

The gas compression apparatus according to this embodiment is a screw-type pump comprising, as shown in FIG. 1, a male rotor 1 and a female rotor 2 (FIG. 2) having a screw shape and teeth in mesh with each other, a rotation transmission mechanism 3 for driving a pair of the rotors 1, 2, and a casing 4 for accommodating a pair of the rotors 1, 2 and the rotation transmission mechanism 3 in spaced relation to each other.

Both the male rotor 1 and the female rotor 2, as shown in FIG. 2, have a male screw shape formed with a spiral protrusion. The rotation transmission mechanism 3, as shown in FIG. 1, receives the turning force from a drive source such as an electric motor 50 to rotationally drive a pair of the rotors 1, 2.

The casing 4 comprises, from the motor 50 side, three parts including a lubrication box 6, a rotor housing 7 and a cover 8 arranged in that order. The lubrication box 6, the rotor housing 7 and the cover 8 are firmly coupled to each other by fastening means such as a bolt (not shown).

A lubricant space 9 formed in the lubrication box 6 accommodates the rotation transmission mechanism 3 and a lubricant oil (an oil as viscous as the engine oil, for example) supplied to the rotation transmission mechanism 3. The gears, etc. making up the rotation transmission mechanism 3 are lubricated with the lubricant oil sprayed thereon in the lubricant space 9.

A pair of the rotors 1, 2 are accommodated in a rotor chamber 10 formed in the rotor housing 7. A pair of the rotors 1, 2 rotate in the rotor chamber 10, so that the rotor chamber 10 and compression chambers 10*a* formed by a pair of the rotors 1, 2 are sequentially reduced in size thereby to compress combustion air (intake air) introduced therein.

The lubrication box 6 is for supporting the input shaft 5 receiving the turning force from the motor 50 through a first bearing 11 arranged on the motor 50 side and a second bearing 12 arranged on the lubricant space 9 side. A first oil seal 13 for preventing lubricant oil supplied to the first and second bearings 11, 12 from flowing out of the casing 4 is mounted in an insertion hole into which the input shaft 5 is inserted and is formed in the lubrication box 6.

An end of the rotative shaft 14 of the male rotor is rotatably supported on the rotor housing 7 through a third bearing 15, and the other end thereof rotatably supported on the cover 8 through a fourth bearing 16.

A second oil seal 18 for preventing lubricant oil supplied to the third bearing 15 from leaking into the rotor chamber 10 through an insertion hole with the male-rotor rotative shaft 14 inserted therein is mounted on a partitioning wall defining the rotor chamber 10 and the lubricant space 9 of the rotor housing 7.

A third oil seal 19 for preventing grease sealed in the fourth bearing 16 from leaking into the rotor chamber 10 is mounted in an insertion hole in which the male-rotor rotative shaft 14 is inserted and is formed in the cover 8.

An end of a female-rotor rotative shaft 20, like the male-rotor rotative shaft 14, is supported on the rotor housing 7 through a fifth bearing 21, and the other end thereof is supported on the cover 8 through a sixth bearing 22.

A fourth oil seal 23 for preventing the lubricant oil supplied to the fifth bearing 21 from leaking into the rotor chamber 10 through an insertion hole with the female-rotor rotative shaft 20 inserted therein is mounted on a partitioning wall defining the rotor chamber 10 and the lubricant space 9 of the rotor housing 7.

Also, a fifth oil seal 24 for preventing grease sealed in the sixth bearing 22 from leaking into the rotor chamber 10 is mounted in an insertion hole in which the female-rotor rotative shaft 20 formed on the cover 8 is inserted.

The rotation transmission mechanism 3 is for synchronously rotating a pair of the rotors 1, 2 by transmitting the rotation of the input shaft 5 to the male- and female-rotor rotative shafts 14, 20. The rotation transmission mechanism 3 includes first and second gears 31, 32 for transmitting the rotation of the input shaft 5 driven by the motor 50 to the male-rotor rotative shaft 14, and third and fourth gears 33, 34 whereby the rotation transmitted to the male-rotor rotative shaft 14 from the second gear 32 is transmitted to the female-rotor rotative shaft 20, etc.

The third and fourth gears 33, 34 are timing gears for synchronously rotating a pair of the rotors 1, 2.

The space 41*a* between the oil seals 18, 23 and the bearings 15, 21 in the partitioning wall defining the rotor chamber 10 and the lubricant space 9 of the rotor housing 7 is adapted to communicate with the atmosphere or a low pressure lead hole 42 open to outside the rotor housing 7, through a blow-down lead hole 41.

An on-off valve 43 for opening/closing the low pressure lead hole 42 is arranged on the low pressure lead hole 42 side of the blow-down lead hole 41. The on-off valve 43 comprises a valve body 44 for opening/closing the low pressure lead hole 42 and a valve body motion space 45 in which the valve body 44 is displaced, etc.

According to this embodiment, the valve body motion space 45 is formed by the rotor housing 7. Nevertheless, this embodiment is not limited to this configuration, but an independent valve housing may be formed to accommodate the valve body 44.

Also, the on-off valve 43 has a configuration in which the force to open the low pressure lead hole 42 is exerted on the valve body 44 by the pressure of the low pressure side exerted on the valve body 44, i.e. the atmospheric pressure and the gravity on the valve body 44, while the force to close the low pressure lead hole 42 is exerted on the valve body 44 by the internal pressure of the space 41*a*.

Specifically, while the valve body 44 is arranged in the valve body motion space 45 in a manner displaceable in a vertical direction, the low pressure lead hole 42 is formed at the upper side of the valve body motion space 45, and the blow-down lead hole 41 communicates with the lower side of the valve body motion space 45.

In the case where the internal pressure of the space 41*a* drops to or below the level corresponding to the atmospheric pressure and the weight of the valve body 44, therefore, the valve body 44 moves downward and opens the low pressure lead hole 42, while in the case where the internal pressure of the space 41*a* is higher than the level corresponding to the atmospheric pressure and the weight of the valve body 44, in contrast, the valve body 44 moves upward and closes the low pressure lead hole 42.

The valve body 44, as shown in FIG. 3, includes a cylindrical portion 44*a* having a cylindrical shape and a lid 44*b* on which the atmospheric pressure and the internal pressure of the space 41*a* are exerted and which closes an axial end of the cylindrical portion 44*a*. According to this embodiment, a plurality of grooves 44*c* are formed on an axial end of the cylindrical portion 44*a* far from the lid 44*b*.

The valve body 44 according to this embodiment, which is formed of resin, is not limited to resin but may alternatively be formed of a metal.

Next, the operation of the compression mechanism according to this embodiment and including a pair of the rotors 1, 2, etc., is explained briefly.

A pair of the rotors 1, 2, as described above, have a male screw shape formed with spiral protrusions. With the synchronous rotation of a pair of the rotors 1, 2 through the rotation transmission mechanism 3, the combustion air is drawn into the compression chamber 10*a* from an inlet 35 formed on the axial end of the rotor housing 7 near the cover 8.

In the process, the compression chamber 10*a* is progressively reduced in volume while moving from the cover 8 side toward the lubricant space 9 side while a pair of the rotors 1, 2 rotate. The combustion air drawn into the compression chamber 10*a*, therefore, is gradually compressed while being moved toward the lubricant space 9.

Once the rotation angle of a pair of the rotors 1, 2 reaches a predetermined value, the compression chamber 10*a* arrives at a discharge port 36 formed in an area near the lubricant space 9. Thus, the compression chamber 10*a* thus far hermetically closed is opened by the discharge port 36, and the compressed combustion air is discharged from the discharge port 36.

According to this embodiment, the hermeticity of the compression chamber 10*a* formed on the side of a pair of the rotors 1, 2 far from the inlet 35 is improved beyond the hermeticity of the compression chamber 10*a* formed on the side of the rotors 1, 2 near to the inlet 35, and the combustion air is compressed in the compression chamber 10*a* formed mainly on the side of a pair of the rotors 1, 2 far from the inlet 35. The discharge port 36, therefore, is formed on one side of the rotor housing 7 in a diagonally opposed relation to the inlet 35 formed on the opposite side of the rotor housing 7. Nevertheless, the discharge port 36 is not, of course, limited to this position.

Now, the functions and effects of the gas compression apparatus according to this embodiment are described.

While the gas compression apparatus is in operation, the internal pressure of the compression chamber 10*a* rises to about 2 atm, the internal pressure of the space 41*a* rises and the valve body 44 moves upward and closes the low pressure lead hole 42. Thus, the lubricant space 9 and the blow-down lead hole 41, etc. are all closed into hermetical state.

As a result, the pressure level of the lubricant space 9, the blow-down lead hole 41, etc. becomes substantially the same as the pressure level (about 2 atm) of the compression chamber 10*a*. Therefore, the combustion air is prevented from leaking from the compression chamber 10*a* to the lubricant space 9, thereby preventing the volume efficiency of the gas compression apparatus from decreasing.

When the operation of the gas compression apparatus stops, the internal pressure of the compression chamber 10*a* decreases. On the other hand, as the internal pressure of the lubricant space 9 is in a high level of about 2 atm, the high-pressure gas in the lubricant space 9 leaks out into the compression chamber 10*a* through the minuscule gaps generated between the rotative shafts 14, 20 of the rotors 1, 2, and the third bearing 15, the fifth bearding 21, the second oil seal 18 and the fourth oil seal 23, respectively.

Due to the leakage of the high-pressure gas in the lubricant space 9 into the compression chamber 10*a*, however, the internal pressures of the space 41*a* and the lubricant space 9 drop rapidly and considerably and then when the pressure acting on the valve body 44 becomes about 1.5 atm the valve body 44 moves downward due to the weight thereof to open the low pressure lead hole 42. As a result, the pressure of the lubricant space 9 is released to outside the casing 4 through the blow-down lead hole 41 and the low pressure lead hole 42, so that the pressure of the lubricant space 9 becomes substantially equal to the atmospheric pressure.

As a result, the pressure of the lubricant space 9 is prevented from increasing beyond the internal pressure of the compression chamber 10*a*. Therefore, the high-pressure gas continuously flows from the lubricant space 9 into the compression chamber 10*a* until the pressure of the lubricant space 9 becomes substantially equal to the internal pressure of the compression chamber 10*a*. It is thus possible to prevent the lubricant oil in the lubricant space 9 from continuously leaking into the compression chamber 10*a*. Therefore, the leakage quantity of the lubricant oil can be considerably reduced in comparison with the prior art.

As long as the low pressure lead hole 42 is open, air in the space 41*a* flows from the inside of the cylindrical portion 44*a* to the outside of the cylindrical portion 44*a* through the grooves 44*c*, and then into the atmosphere from the low pressure lead hole 42. Therefore, a path connecting the low pressure lead hole 42 and the space 41*a* constitutes a zigzag maze structure.

As a result, only the air low in density and more liable to flow is discharged out of the casing 4 from the low pressure lead hole 42, while the lubricant oil higher in density and less liable to flow than the air remains on the lower side in the valve body motion space 45. The lubricant oil is thus prevented from being discharged out of the casing 4, while at the same time making it possible to reduce the internal pressure of the space 41*a* and the lubricant space 9 by discharging only the air out of the casing 4 quickly.

Further, the lubricant oil is prevented from being reduced in amount, which in turns eliminates the need of frequent maintenance work, while at the same time positively preventing the lubricant oil from leaking from the lubricant space 9 side into the compression chamber 10*a*.

Second Embodiment

Figure 4:
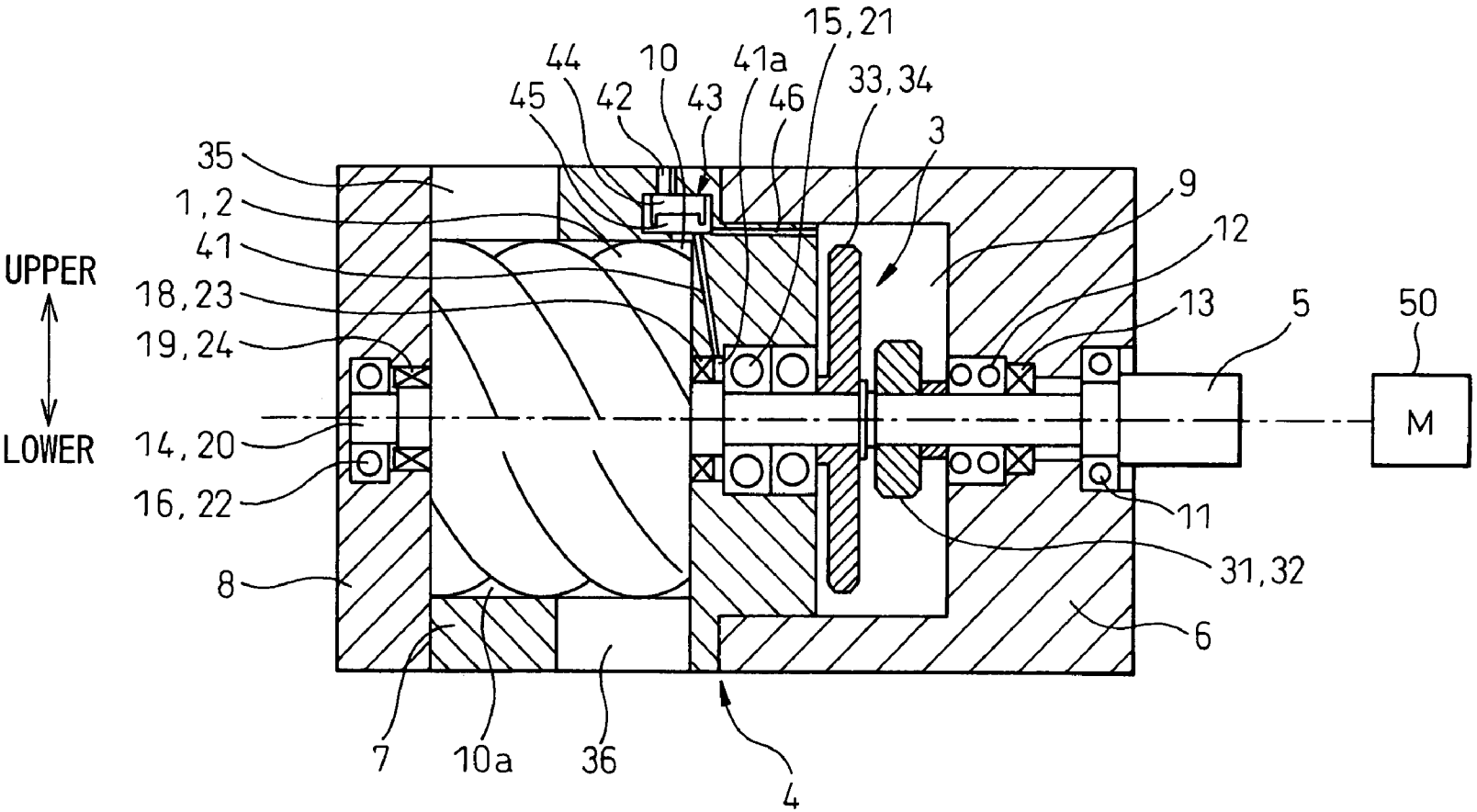
FIG. 4 is a sectional view taken along the axis of a gas compression apparatus according to a second embodiment of the invention.

FIG. 4 is a sectional view of a gas compression apparatus according to a second embodiment of the invention. The difference of the second embodiment from the first embodiment are mainly explained below with reference to FIG. 4. In FIG. 4, the same reference numerals as those in the first embodiment designate the component parts having the same functions, respectively, which are not described again.

Specifically, according to the second embodiment, a lubricant return groove 46 is formed to return lubricant oil staying on the lower side of the valve body motion space 45 into the lubricant space 9.

In view of the fact that the lubricant oil staying on the lower side of the valve body motion space 45 can be returned to the lubricant space 9, the blow-down lead hole 41 is prevented from being clogged by the lubricant oil. Thus, the high-pressure air in the space 41*a* and the lubricant space 9 can be quickly discharged to the atmosphere as soon as the operation of the gas compression apparatus stops.

Immediately after the gas compression apparatus stops operating, therefore, the internal pressure of the space 41*a* and the lubricant space 9 can be reduced. Thus, the chance of the lubricant oil leaking from the lubricant space 9 into the compression chamber 10*a* can be reduced positively.

Third Embodiment

Figure 5A:
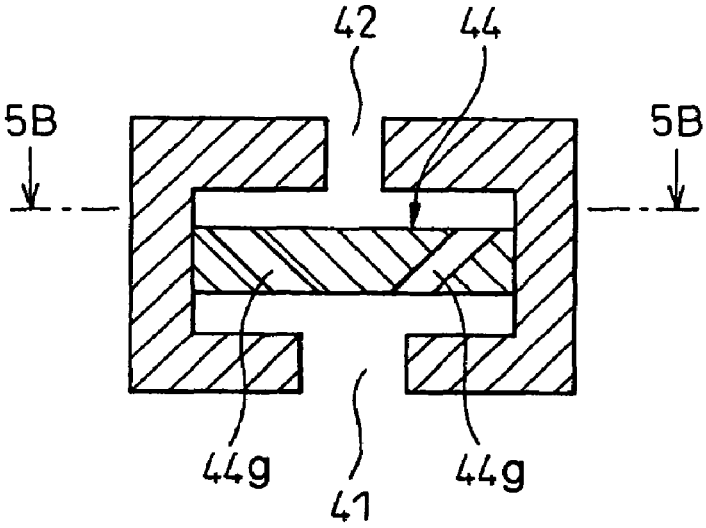
FIG. 5A is an elevational sectional view of an on-off valve of a gas compression apparatus according to a third embodiment of the invention.
Figure 5B:
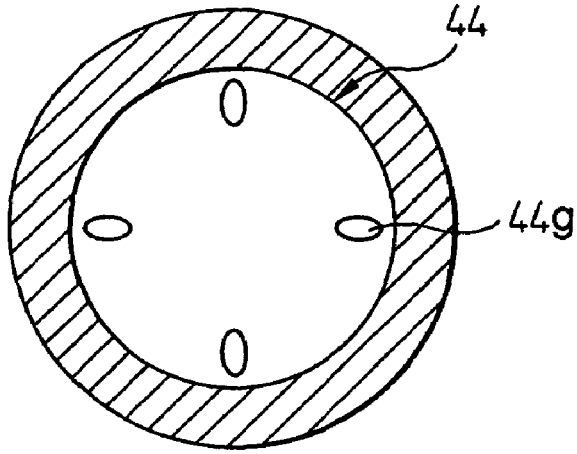
FIG. 5B is a sectional view taken along the line 5B—5B in FIG. 5A.

According to the first and second embodiments, the grooves 44*c* are formed on the cylindrical portion 44*a* to constitute a zigzag maze structure of the path connecting the low pressure lead hole 42 and the space 41*a*. According to this embodiment, on the other hand, as shown in FIGS. 5A, 5B, a plurality of oblique holes 44*g* are formed in the valve body 44 to make up a zigzag maze structure of a path connecting the low pressure lead hole 42 and the space 41*a*.

Fourth Embodiment

Figure 6A:
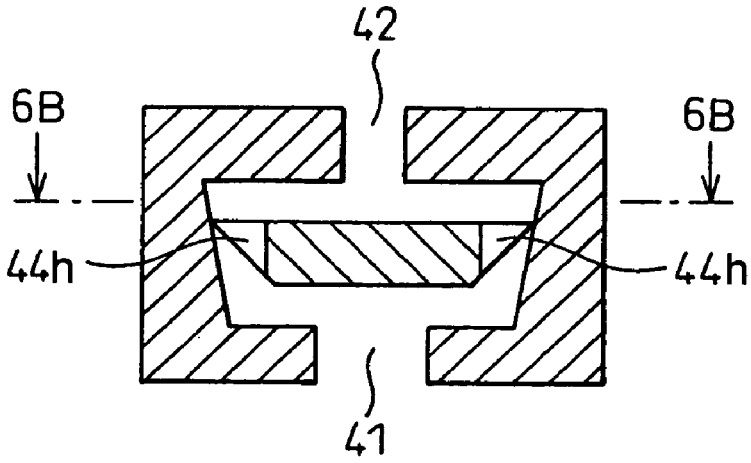
FIG. 6A is an elevational sectional view of an on-off valve of a gas compression apparatus according to a fourth embodiment of the invention.
Figure 6B:
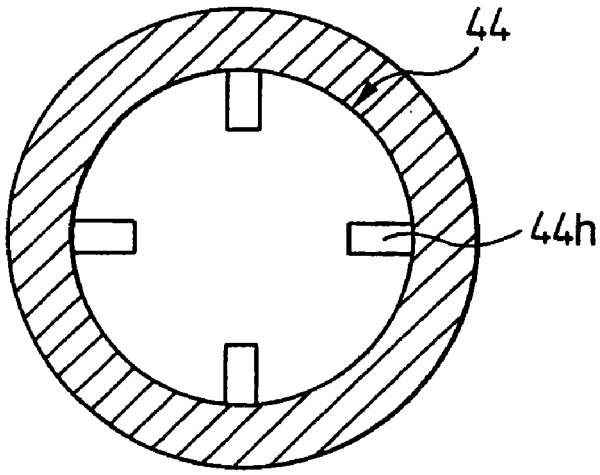
FIG. 6B is a sectional view taken along the line 6B—6B in FIG. 6A.

According to this embodiment, as shown in FIGS. 6A, 6B, a plurality of holes 44*h* are formed in the outer peripheral portion of the circular disc-shaped valve body 44 to form a zigzag maze structure of a path connecting the low pressure lead hole 42 and the space 41*a*.

Fifth Embodiment

Figure 7A:
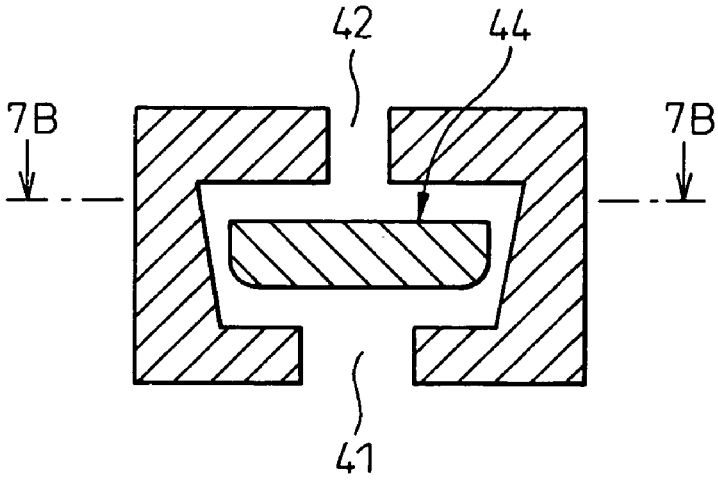
FIG. 7A is an elevational sectional view of an on-off valve of a gas compression apparatus according to a fifth embodiment of the invention.
Figure 7B:
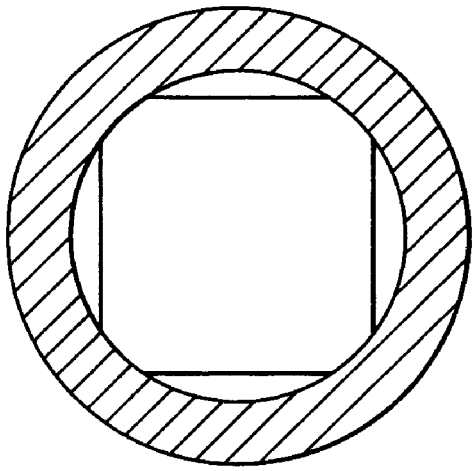
FIG. 7B is a sectional view taken along the line 7B—7B in FIG. 7A.

According to this embodiment, as shown in FIGS. 7A, 7B, the valve body 44 is formed substantially as a rectangle with respect to the cylindrical valve body motion space 45. Thus, air passages are formed along the outer periphery of the valve body 44 when the low pressure lead hole 42 opens to thereby make up a zigzag maze structure of a path connecting the low pressure lead hole 42 and the space 41*a*.

Other Embodiments

Although the embodiments of the invention described above are used for a gas compression apparatus for compressing combustion air, the present invention is not limited to such an application but may be applicable also to a gas compression apparatus for compressing hydrogen or other gases as well.

Also, applications of the invention are not limited to the gas compression apparatus of screw type as in the embodiments described above, but can also include the displacement compressor of a root type, a scroll type, or the like, with equal effect.

Further, in the embodiments described above, the direction in which the valve body 44 moves is vertical, that is, the valve body 44 is moved taking advantage of the weight thereof, so that no practical problem is posed as long as the direction in which the valve body 44 moves is not more than ±45 degrees to the normal.

Although the valve body 44 is moved using the weight thereof in the embodiments described above, the invention is not limited to such a method, but the force equivalent to the weight of the valve body 44 may be derived from an elastic means such as a spring.

In the embodiments described above, the low pressure lead hole 42 is opened to the atmosphere. The invention, however, is not limited to such a configuration, but the low pressure lead hole 42 may be opened to the inlet 35, for example.

This invention is applicable to any case not departing from the spirit and scope of the present invention described in the appended claims. The invention, therefore, is not limited to the embodiments described above.

While the invention has been described by reference to specific embodiments chosen for the purposes of illustration, it should be apparent that numerous modifications could be made thereto, by those skilled in the art, without departing from the basic concept and scope of the invention.

The invention claimed is:

1. A gas compression apparatus comprising:

rotative members rotated in a housing;

bearings for rotatably supporting the rotative members;

a lubricant space sealed with lubricant oil for lubricating the bearing;

seal members for preventing the lubricant oil from leaking into a compression chamber formed by the housing and the rotative members; and an on-off valve for opening/closing a low pressure lead hole for establishing communication between a space nearer to the bearings from the seal members and a low pressure side and when an internal pressure of the space decreases to at least a predetermined level, opening the low pressure lead hole.

2. A gas compression apparatus according to claim 1, wherein the on-off valve has a maze structured path connecting the low pressure lead hole and the space while the low pressure lead hole is open.

3. A gas compression apparatus according to claim 1:

wherein the valve body of the on-off valve includes a cylindrical portion having a cylindrical shape and a lid for closing an axial end of the cylindrical portion; and wherein an axial end of the cylindrical portion far from the lid is formed with a plurality of grooves.

4. A gas compression apparatus according to claim 3, wherein the valve body is subjected to force in a direction to open the low pressure lead hole by pressure of the low pressure side acting on the valve body and gravity on the valve body, while the valve body is also subjected to force in a direction to close the low pressure lead hole by an internal pressure of the space.

5. A gas compression apparatus according to claim 1, wherein a direction in which the valve body moves is not more than ±45 degrees to the normal.

6. A gas compression apparatus according to claim 1, further comprising a lubricant return path for returning the lubricant oil staying in the on-off valve side to the lubricant space.

7. A gas compression apparatus according to claim 1, wherein the low pressure lead hole is open to the atmosphere.

8. A gas compression apparatus according to claim 1, wherein the valve is arranged at an upper position in the lubricant space.

9. A gas compression apparatus comprising:

rotative members rotated in a housing;

bearings for rotatably supporting shafts of the rotative members;

a casing forming a lubricant space sealed with lubricant oil for lubricating the bearing;

a compression chamber formed by the housing and the rotative members;

minuscule gaps generated at the contact surfaces of the shafts and the bearings and establishing communication between the compression chamber and the lubricant space;

seal members for preventing the lubricant oil in the lubricant space from leaking into the compression chamber through the minuscule gaps;

a communication path at least communicating the lubricant space with outside atmosphere; and a valve provided in the communication path and for opening the communication path when the internal pressure of the lubricant space decreases to at least a predetermined level.

10. A gas compression apparatus according to claim 9, wherein the compression chamber communicates with outside atmosphere through the communication path, and the valve is opened when the internal pressure of the compression chamber decreases to at least the predetermined level.

11. A gas compression apparatus according to claim 9, wherein the valve is arranged at an upper position in the lubricant space.

* * * * *